United States Patent [19]

Sato et al.

[11] 4,436,573

[45] Mar. 13, 1984

[54] PORTABLE LABEL APPLYING MACHINE

[75] Inventors: Yo Sato, Tokyo; Tadao Kashiwaba, Kitakami, both of Japan

[73] Assignee: Kabushiki Kaisha Sato, Japan

[21] Appl. No.: 452,707

[22] Filed: Dec. 23, 1982

Related U.S. Application Data

[63] This application is a continuation in Part of Application Ser. No. 368,732.

[30] Foreign Application Priority Data

Dec. 28, 1981 [JP] Japan ..... 56-210021
Jan. 20, 1982 [JP] Japan ..... 57-4943[U]

[51] Int. Cl.[3] ..... B65C 9/18; B65C 11/00

[52] U.S. Cl. ..... 156/384; 101/288; 156/577; 156/579; 156/584; 156/DIG. 33; 156/DIG. 48

[58] Field of Search ..... 156/184, 277, 384, 344, 156/459, 577, 579, 584, DIG. 33, DIG. 48; 101/288

[56] References Cited

U.S. PATENT DOCUMENTS 3,801,408 4/1974 Kuring et al. ..... 156/584
3,944,455 3/1976 French ..... 156/584
4,359,939 11/1982 Sato ..... 101/288

*Primary Examiner*—Michael G. Wityshyn
*Attorney, Agent, or Firm*—Ostrolenk, Faber, Gerb & Soffen

[57] ABSTRACT

A portable label applying machine for applying labels to articles, especially accurate labels previously printed with distinct and accurate indications such as bar codes. The label applying machine carries a label cassette. The label cassette is removable and replaceable as a unit in the label applying machine. The label cassette is a complete unit with a supporting section for supporting a rolled label strip, a peeling section to peel labels and a guide section to guide a backing paper of the label strip; and an applying device which detachably holds the label cassette and is provided with a self-contained feeding mechanism to shift the backing paper and an applying section for applying peeled labels to articles. A plurality of cassettes with pre-printed bar code labels may be used interchangeably with a single label applying machine.

22 Claims, 19 Drawing Figures

PORTABLE LABEL APPLYING MACHINE

This application is a continuation-in-part of application Serial No. 368,732, filed April 15, 1982.

BACKGROUND OF THE INVENTION

1. Field of the Invention

This invention relates to a portable label applying machine. More particularly, the invention relates to a label applying machine which is used for peeling removably positioned labels from a web of backing paper on which the labels are positioned one after the other in series and applying the peeled labels to articles such as commodities.

2. Description of the Prior Art

Portable label applying machines of this type which are commonly used in retail shops, supermarkets and the like, are provided with various label printing and applying mechanisms. The label printing and applying machine is generally composed of a supporting device, a printing head, a feeding device and a peeling device. The supporting device supports a rolled label strip in which a plurality of unprinted labels are carried in sequential or series end-to-end relationship on a web of backing paper. The printing head prints the necessary information on the labels. The feeding device advances the label strip and the peeling device peels printed labels one by one from the web of backing paper and delivers the labels outside the machine body. In the portable label printing and applying machine, the printing, feeding and peeling operations are done manually and the peeled labels are attached to articles by pressing them onto said articles.

This portable label printing and applying machine is used for applying printed labels to commodities usually at a sales counter or an article supporting rack in which commodities are displayed or just prior to the placing the articles on display. A system which is now called POS (point of sales) has recently come into use. In that system bar codes are used to provide information. However, the following problems arise in the printing and applying operation of bar code labels:

(1) Strict accuracy in the widths and spacings of bar code lines are required because the bar codes are read by means of an optical reader. However, the printing head mounted on a portable label printing and applying machine is generally simple in structure so that structural aberration of the printing head is liable to occur. In addition, the application of ink with an inking roller applied to the set up typeface structure for transfer to the label often results in irregular application of ink or application of too much or too little ink. As a result, bar codes are not accurately printed and they are often read incorrectly by an optical reader.

(2) Since the sizes of bar codes are standardized and the elements are larger than those of ordinary characters, the size of bar code printing head becomes larger than that of a printing head for ordinary characters. As a result, the portable label printing and applying machine must be made large in size and weight, which creates handling problems and fatigue in operation.

(3) Check digits are necessary for bar codes. However, the size and structure of the portable label printing and applying machine are limited so that it is difficult to provide the machine with an automatic calculating mechanism. Therefore, the check digits must be calculated separately and be set in the printing head, which is also disadvantageous in practical operation.

Since the portable label printing and applying machines for bar codes had the foregoing problems, the label printing and applying operation was carried out also by printing the labels on the label strip by using a table printing machine. The printed labels were then peeled off one by one by hand and applied to articles. However, this manual applying method reduced the work efficiency and the printed information on labels was often soiled or blurred because the label surfaces were rubbed by the fingers which manually applied the labels.

Accordingly, an apparatus which is capable of performing properly the printing and applying operation of bar code labels in an accurate and efficient manner has not been previously available although the need therefor has been substantial.

Besides the above-described label printing and applying machine, portable label applying machines of another type are widely used, in which the printing function of the former label printing and applying machine is omitted in the latter machines. These label applying machines are used for applying labels which are not printed or have been previously printed by a separate printing machine with indications, for example, for sales promotion such as "Special Sale", "Bargain", "New Sale", "30% Discount" etc. In the label applying machines of this type, the replacing of a label strip is quite troublesome and takes much time. That is, the label replacing must be carried out by first obtaining access to some portion of the run or path of the label strip. The bottom cover of the portable label device is lifted, the label strip is then pulled out and it is detached from the supporting section, a new rolled label strip is then mounted on the supporting section, the label strip is next threaded through the desired path to set the label strip in the machine and the bottom cover is closed.

Where such label replacement has become a problem, the solution to the problem was the use of a plurality of label applying machines set with several kinds of labels. This is quite uneconomical.

Accordingly, it has also been desired to provide an improved label applying machine in which label replacement can easily and quickly be performed and which machines can be produced at low cost.

Related efforts to resolve the above-noted problems of the prior art are described in U.S. application Ser. No. 354,060, filed Mar. 2, 1982 and Ser. No. 368,732, filed Apr. 15, 1982.

BRIEF SUMMARY OF THE INVENTION

The object of the present invention is to overcome the said problems of the prior art and to provide an improved portable label applying machine which is free from the foregoing disadvantages and can satisfy the foregoing demands.

Another object of the present invention is to provide a portable label applying machine for applying labels to articles in which the label applying operation can be done rapidly with reduced operator fatigue.

A further object of the present invention is to provide a portable label applying machine in which the operation of replacing the type of label to be applied is performed more easily and rapidly than in prior label applying machines.

Still a further object of the present invention is to provide a portable label applying machine which is simple in structure providing simplicity in manufacture and long service life for the machine.

Another object of the present invention is to provide a portable label applying machine for applying labels to articles, which labels have been previously printed accurately with bar codes and check digits.

Still a further object of the present invention is to provide a portable label applying machine which does not blur, smudge or soil printed labels when they are applied to articles.

Another object of the present invention is the provision of a detachable replaceable label cassette which is self-contained and provides all the elements for guiding a label strip when the strip is driven by the applying machine.

In accordance with the present invention, the portable label applying machine comprises a label cassette which can be detachably mounted on a printing device to print a label strip and which is provided with a supporting section for a rolled label strip on which a plurality of labels are removably positioned on a web of backing paper; a peeling section which bends said backing paper to peel off said labels; and a self-contained guide section which guides said bent backing paper, and an applying device which detachably holds said label cassette and is provided with a feeding mechanism to shift said bent backing paper and peels off said labels; and an applying section serviceable for applying said peeled labels to articles. A plurality of such label cassettes with pre-printed bar code labels may be interchangeably used with a single label applying machine.

BRIEF DESCRIPTION OF THE DRAWINGS

The foregoing and other objects of the present invention will become more apparent from the following description of a preferred embodiment taken in connection with the accompanying drawings, in which.

DESCRIPTION OF THE PREFERRED EMBODIMENT

Figure 1:
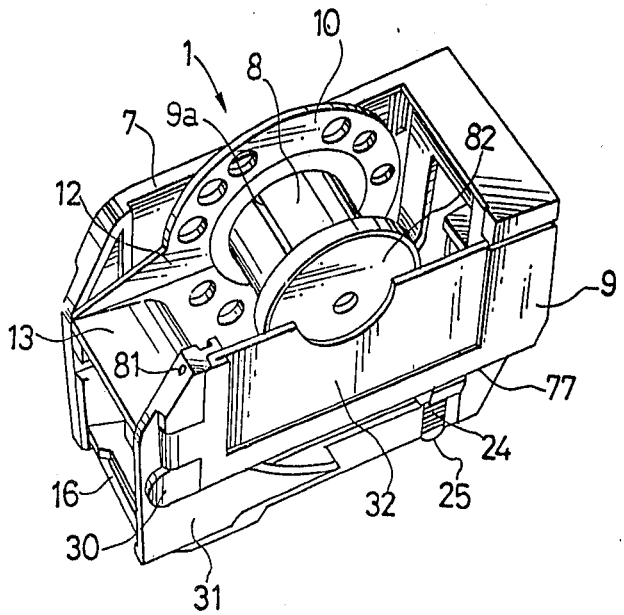
FIG. 1 is a perspective view of a label cassette.

Referring now to the accompanying drawings, the portable label applying machine of the present invention will be described in more detail.

The label printing machine comprises a label cassette 1 and an applying device 2. The label cassette 1 supports a rolled label strip 3.

The cassette 1 can be detachably mounted on the applying device 2. The applying device 2 advances the tape-like label strip 3 by manual operation and peels labels 6 from a backing paper 5, thereby bringing the label 6 into a condition and a position to be applied.

A supporting cylinder winding core 8 is provided to support the rolled label strip 3 and is rotatably attached to a machine frame 7 on one side of the label cassette 1. The label strip 3 may be secured to the winding core 8 in any suitable manner. In one form, a plurality of slots 9*a* are formed in the outer surface of the winding core 8 and when the label strip 3 is to be wound on the winding core 8, the free end of the label strip 4 is inserted into and secured by one of the slots 9*a*. Another and preferred method is by use of the C-shaped member 86 of FIG. 15 and the slot edges 87 formed thereby and hereinafter described.

Figure 9:
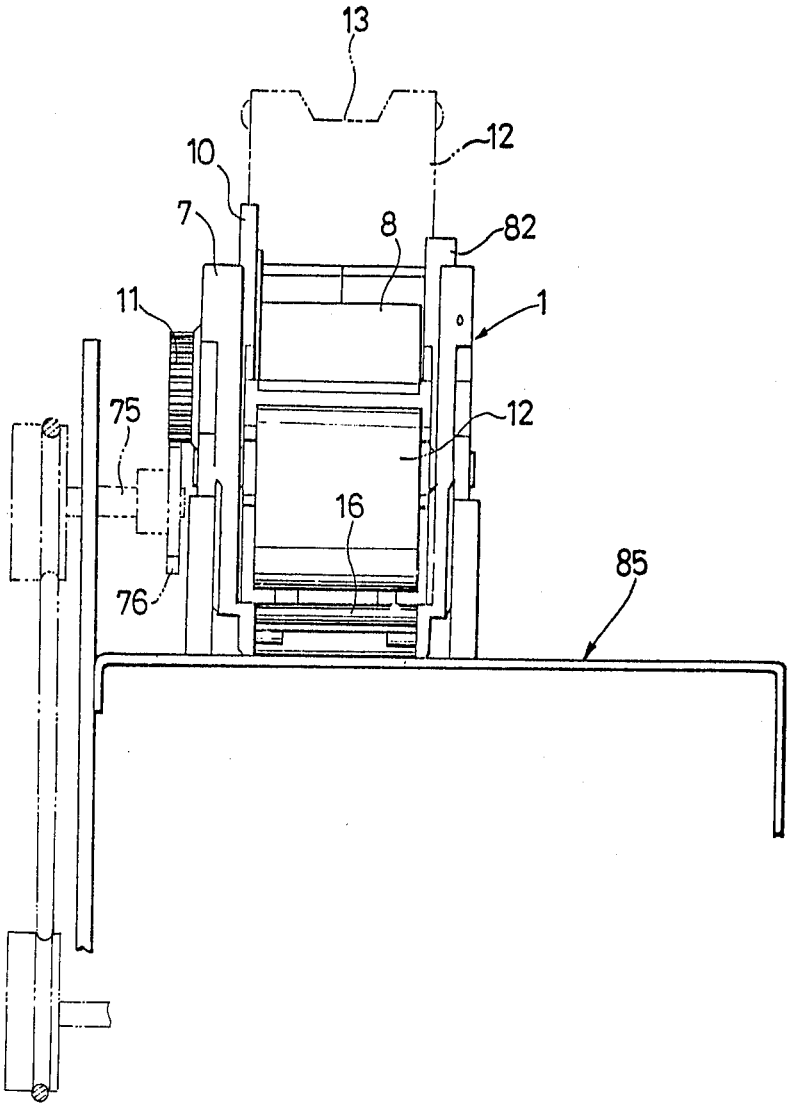
FIG. 9 is a front view of the label cassette which is mounted on a printing device.

As shown in FIG. 9, one side of the supporting cylinder 8 is provided with a toothed wheel 11 of small diameter which is located outside the machine frame 7. A turning member 12 is pivotally supported by a circular projection 80 (FIG. 11C) which is formed on the inside of the machine frame 7. Its rear side wall serves as a supporting plate 10 which prevents the rolled label strip 3 on the cylinder 8 from loosening and moving or spilling to one side. When desired, a pair of circular plates 10 may be used further to control the coiled strip 3.

In the front portion of the turning member 12, there is provided a label pressing member 13.

Figure 8:
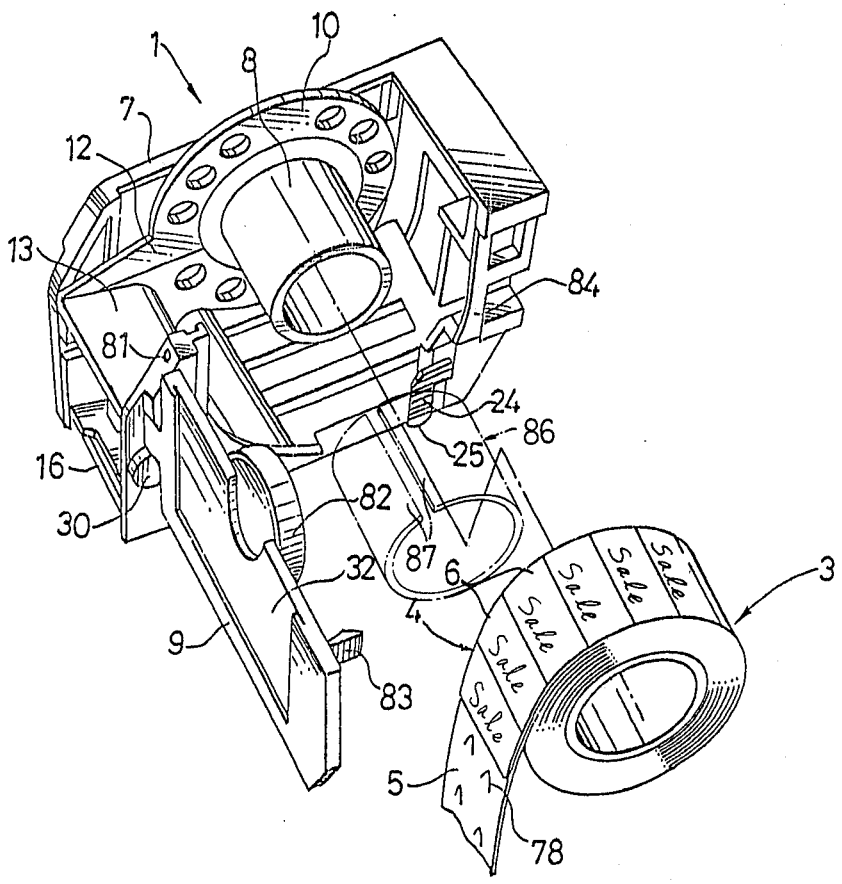
FIG. 8 is a perspective view of the label cassette showing the fitting of a rolled label strip.

A closing plate 9 is attached to one side of the machine frame 7 by a pin 81 and can be opened and closed. An indication card holder 32 is formed in the outside wall of the closing plate 9. On the inside wall of the closing plate 9, there are provided a circular push plate 82 in the middle portion and an elastic hook 83 at an end portion thereof (FIG. 8).

Figure 3:
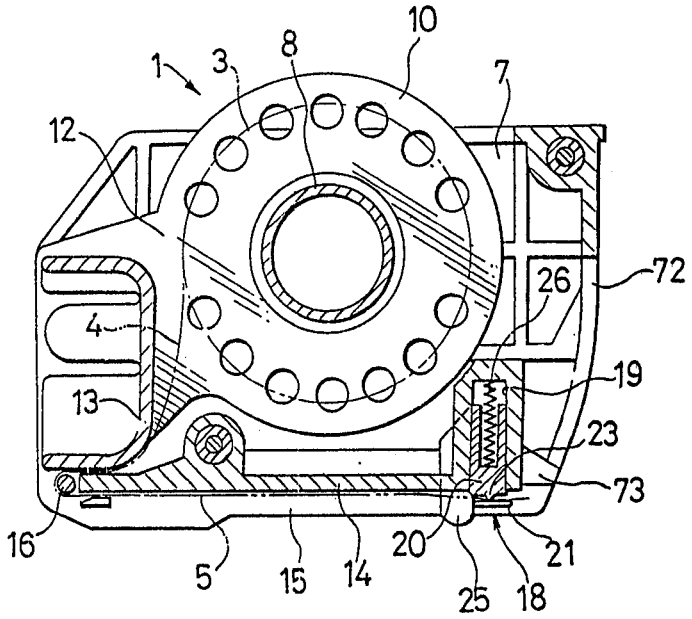
FIG. 3 is a vertical cross-sectional view of the label cassette.
Figure 5:
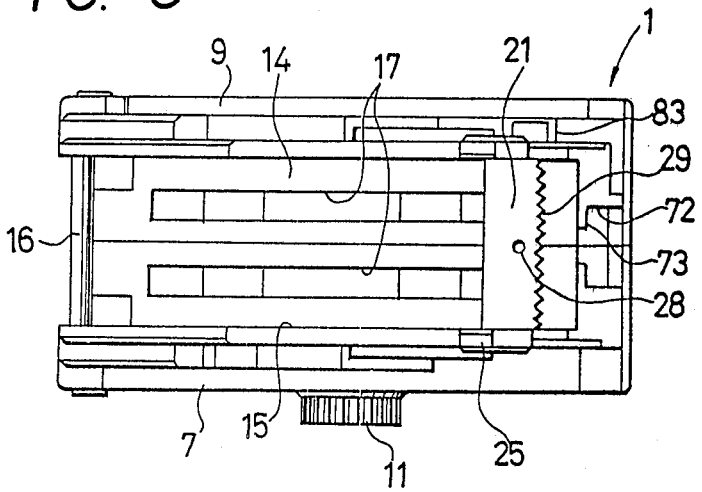
FIG. 5 is a bottom view of the same.

As shown in FIG. 3, a backing paper guide groove 15 is formed from the front end to the rear end of the bottom face of the label cassette 1. As shown in FIG. 5, a pair of pawl guides 17 are formed extending longitudinally in the bottom plate 14. A bending pin 16 for bending the backing paper 5 is attached in front of the bottom plate 14. A backing paper pressing mechanism 18 is formed in the rear portion of the bottom plate 14.

Figure 11:
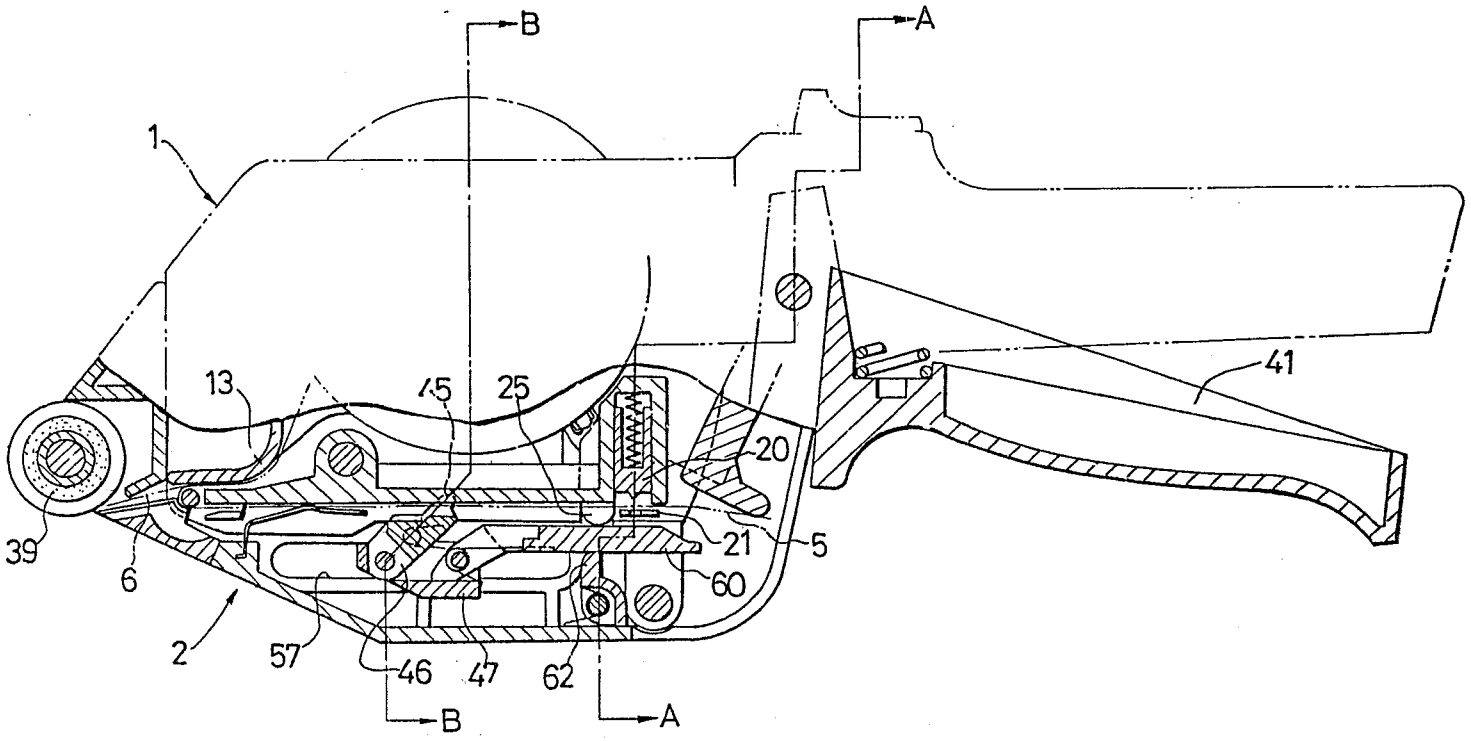
FIG. 11A is a vertical cross-sectional view of the main part of the portable label applying machine in which the hand lever is partway squeezed.
FIG. 11B is a vertical cross-sectional view of the portable label applying machine taken along the line A—A in FIG. 11A.
FIG. 11C is also a vertical cross-sectional view of the portable label applying machine taken along the line B—B in FIG. 11A.
Figure 11:
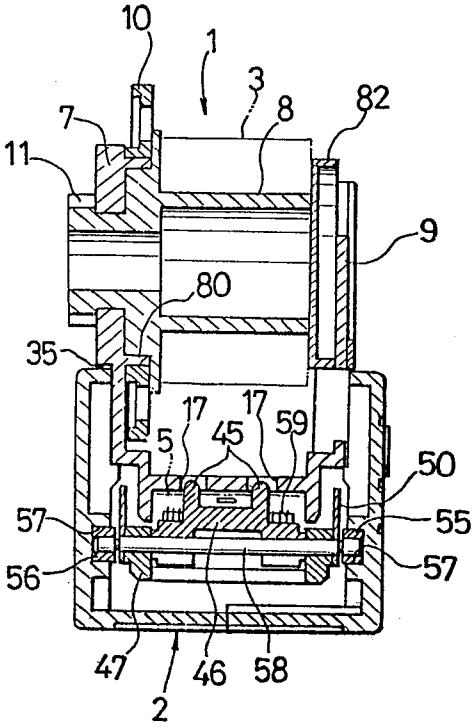
Figure 11:
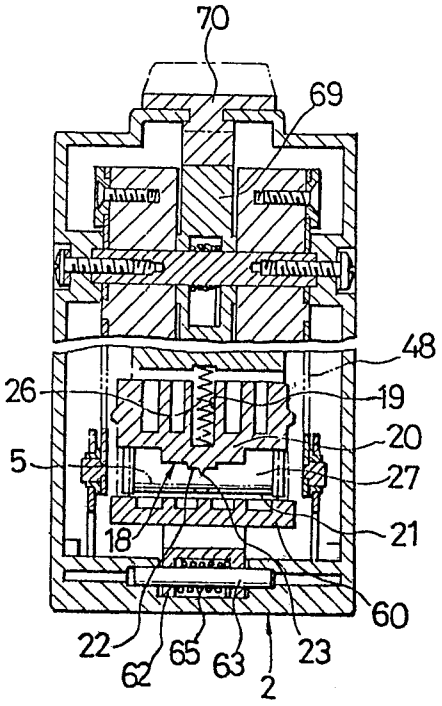

The backing paper pressing mechanism 18 comprises a pressing member 20 and a counter plate 21 which is attached to the rear end of the backing paper guide groove 15. The pressing member 20 is a vertically slidably fit in a recess 19 which is formed in the frame 7. As shown in FIG. 11B, pressing portion 22 is formed on the bottom face of the pressing member 20. A needle 23 protrudes from the center of the underside of the pressing portion 22.

The pressing member 20 is integrally provided on both sides thereof with a pair of finger plates 24. The lower end of each finger plate 24 is provided with a semicircular tongue piece 25. The pressing member 20 is biased downward by a spring 26 which is held within the recess 19. As a result, the tongue pieces 25 normally protrude from the bottom face of the label cassette 1 and the pressing portion 22 is brought into contact with the upper face of the counter plate 21.

The counter plate 21 is so attached that a space 27 sufficient to pass the backing paper 5 therethrough is left between the counter plate 21 and the bottom plate 14. An aperture 28 to receive the needle 23 of the pressing member 20 is defined at the center of the counter plate 21. On the rear edge of the counter plate 21, a cutter 29 for cutting the backing paper 5 is provided as shown in FIG. 5.

Semicircular engaging projections 30 are formed on both side front ends of the label cassette 1. The lower parts on both sides of the label cassette 1 form slightly retreated mounting portions 31 which are serviceable when the label cassette 1 is attached to a printing device 85. An engaging portion 84 comes into engagement with the aforesaid elastic hook 83 (FIG. 8).

Figure 2:
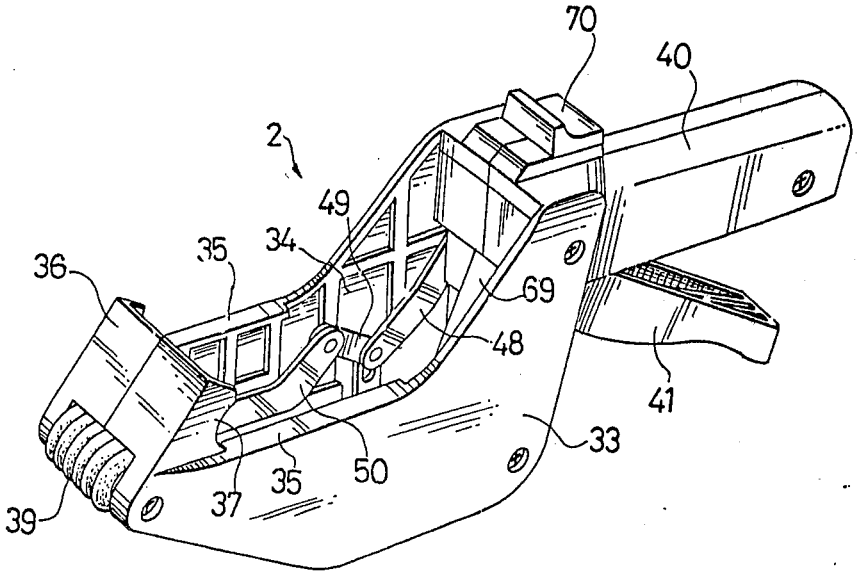
FIG. 2 is a perspective view of a label applying machine.

The applying device 2 will be described with reference to FIGS. 2, 6 and 7. The upper part of the inside of the machine frame 33 is a receiving section 34 to receive therein the label cassette 1. The upper horizontal edges of the machine frame 33 constitute a supporting section 35 which protrudes a little inward. In the rear side of each front wall 36 of the machine frame 33, a semicircular engaging recess 37 is formed. Further, an applying roller 39 is rotatably secured to the front end of the machine frame 33 and a label exit 38 is opened under the roller 39.

The rear portion of the machine frame 33 is elongated to form a hand grip 40. A hand lever 41 is privotally secured to a pivot shaft 42 and under the hand grip 40. Between the hand grip 40 and the hand lever 41 is fitted a return spring 43, thereby urging the hand lever 41 in the clockwise direction.

A feeding mechanism 44 for advancing the backing paper 5 is formed in the lower portion within the machine frame 33. The feeding mechanism 44 comprises a pawl member 46 having a pair of feeding pawls 45 on its upper side, a supporting frame 47 to support the pawl member 46, and first, second and third links 48, 49 and 50 which move the supporting frame back and forth.

One end of the first link 48 is fixed to the hand lever 41 and the other end of the link 48 is provided with a roller 51 which is fitted into a slot 52 that is formed in the second link 49. The lower end of the second link 49 is pivotally secured to a pin 53 which is horizontally disposed between the side walls of the machine frame 33. The upper end of the second link 49 is pivotally linked to a pivot pin 54 which is disposed in one end portion of the third link 50 and the other end of the third link 50 is fixed to the supporting frame 47.

Figure 7:
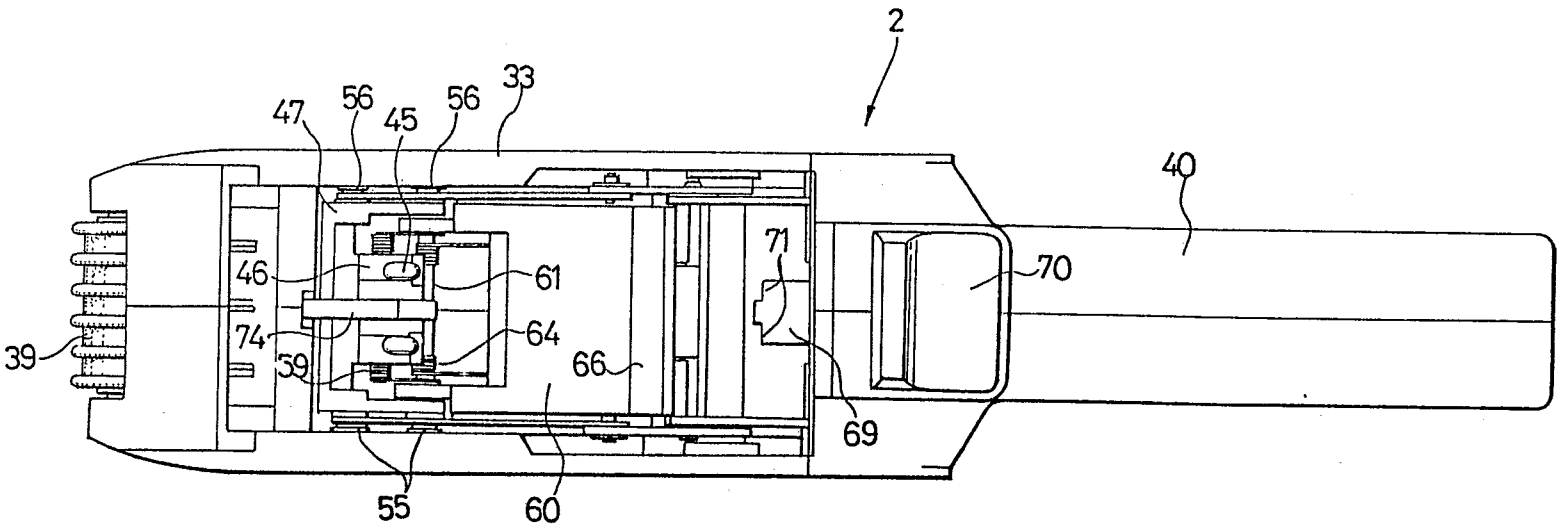
FIG. 7 is a plan view of the same.

The supporting frame 47 is U-shaped as shown in FIG. 7 and is provided on both sides with a pair of rollers 55 and 56. Rollers 55, 56 are fitted into guide grooves 57 which are formed in the inside walls of the machine frame 33 (FIG. 11A).

The pawl member 46 is pivotally supported by pin 58 which is horizontally disposed in the supporting frame 47. The pawl member 46 is normally urged by springs 59 in a counterclockwise direction with respect to FIG. 6.

A push-up plate 60 is pivotally supported by a pin 61 which is horizontally disposed in the rear portion of the supporting frame 47 and a supporting member 62 is pivotally supported by a pin 63 which is horizontally disposed between the side walls of the machine frame 33. The former push-up plate 60 is urged counterclockwise by a spring 64 and the latter supporting member 62 is urged clockwise by a spring 65 as viewed in FIG. 6. A tapered portion 66 is formed in the upper rear portion of the push-up plate 60. In the rest condition shown in FIG. 10A, the undersurface at the rear of the push-up plate 60 is supported by the top face of the supporting member 62.

Figure 4:
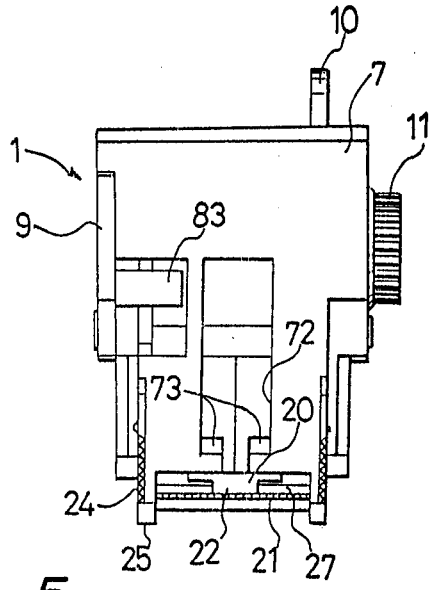
FIG. 4 is a rear side elevation of the same.
Figure 6:
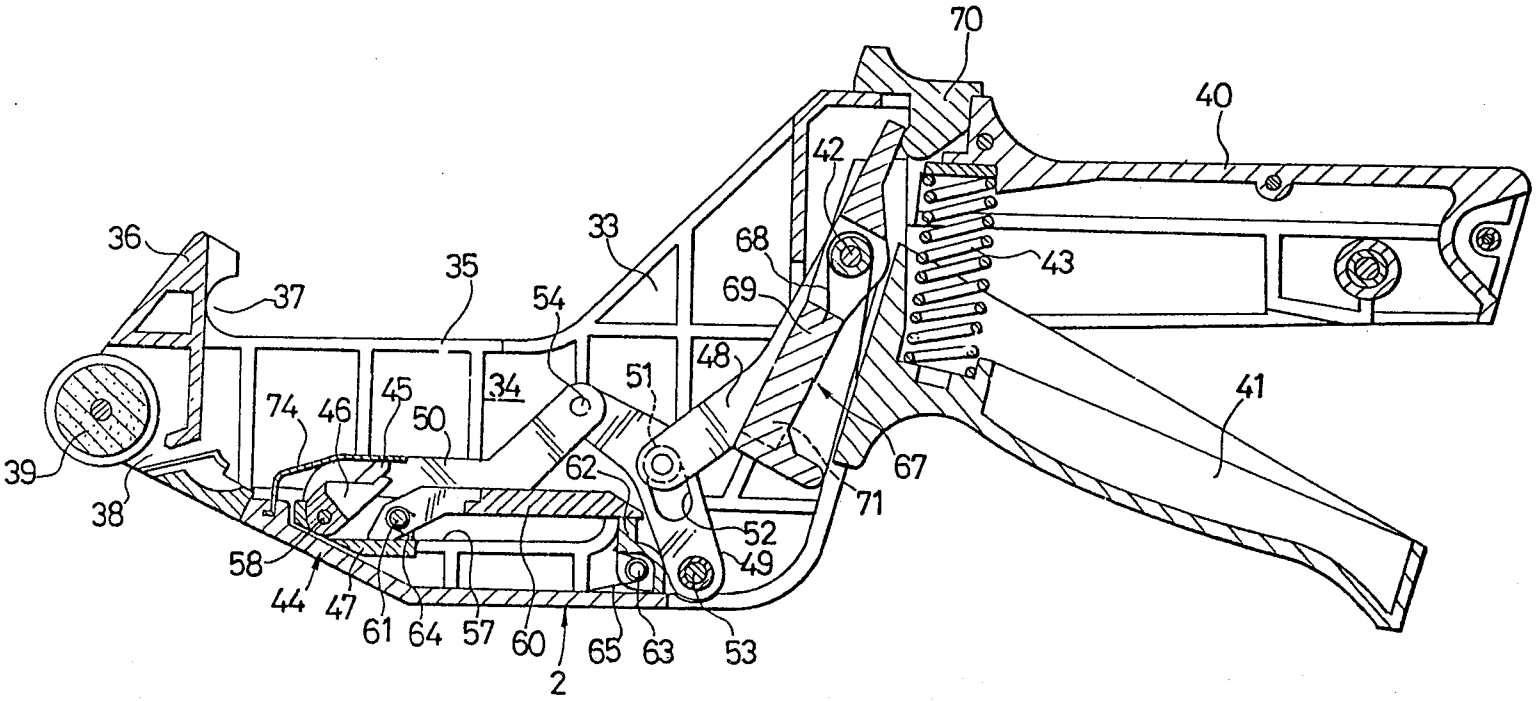
FIG. 6 is a general view in vertical cross-section of a portable label applying machine.

As shown in FIG. 6, a locking mechanism 67 is disposed in the rear portion of the machine frame 33, which mecahnism 67 locks the label cassette 1 when it is attached to the machine frame 33. The locking mechanism 67 is comprised of a locking member 69 and a release button 70. The locking member 69 is pivotally secured to the machine frame 33 and is normally urged clockwise by a spring 68. The release button 70 is reciprocally slidable at the upper rear end of the machine frame 33 and a portion of the button 70 is in contact with the locking member 69. When the label cassette 1 is mounted on the applying device 2, the lower edge portion 71 of the locking member 69 comes into engagement with the engaging portion 73 at the lower end of the opening 72 formed in the rear side of the label cassette 1. (See FIGS. 4, 7 and 10A).

A backing paper pressing plate 74 which is made of a leaf spring is attached to the machine frame 33 in front of the aforesaid pawl member 46.

The operation of the label applying machine of the present invention will be described in the following.

There are two methods of operation in which the label applying machine of the present invention may be used. In one method of operation, a previously printed rolled label strip or an unprinted rolled label strip is attached to the label cassette 1. In another method of operation, the label cassette 1 is detachably mounted on a printing device and a label strip is printed and automatically wound on the supporting cylinder 8 to be used.

In the first method of operation, as shown in FIG. 8, the closing plate 9 in the side face of the label cassette 1 is opened, the rolled label strip 3 is attached to the supporting cylinder 8 and the closing plate 9 is closed. Then, the turning member 12 is stood upright with its label pressing portion 13 located at the top. The free end portion of the label strip 4 is pulled out to a desired length and several labels 6 are peeled off. As shown in FIG. 3, the remainder of the backing paper 5 is bent rearward over the front face of the bending pin 16 and the free end of the backing paper 5 is inserted into the space between the pressing portion 22 and the counter plate 21. More particularly, when the finger plates 24 are slid up with fingers, the whole of the pressing member 20 moves upward. The backing paper 5 is then inserted into the space between the pressing portion 22 and the counter plate 21 and, when the fingers are released, the pressing member 20 is moved down by the force of the spring 26. Thus, the backing paper 5 is pinched between the pressing portion 22 and the counter plate 21. In addition, the needle 23 enters the backing paper 5 to secure the backing paper 5. Next, the upright turning member 12 is turned back to the original position as shown in FIG. 3 and the label pressing portion 13 is brought into contact with the label strip 4.

Figure 10:
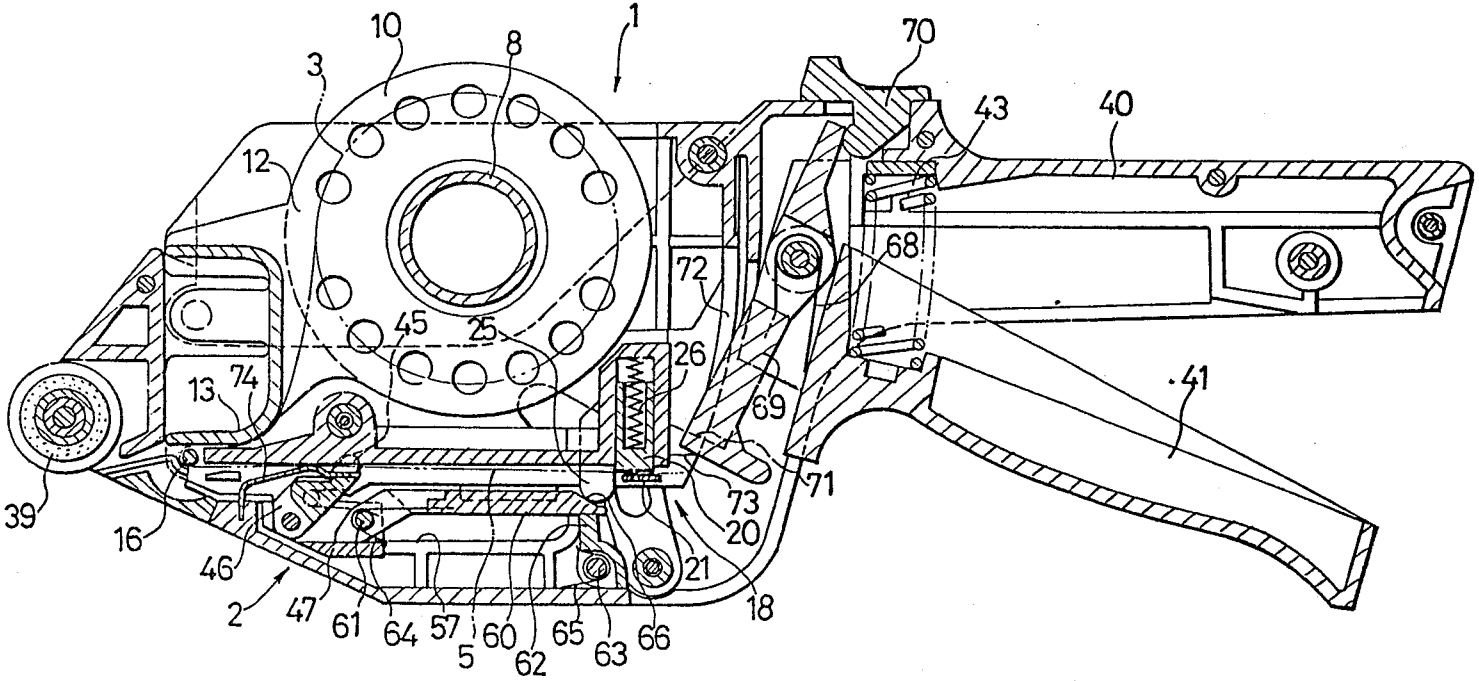
FIG. 10A is a vertical cross-sectional view of the portable label applying machine on which the label cassette is removably mounted.
FIG. 10B is a side elevation of the portable label applying machine in which a machine frame on this side is removed.
Figure 10:
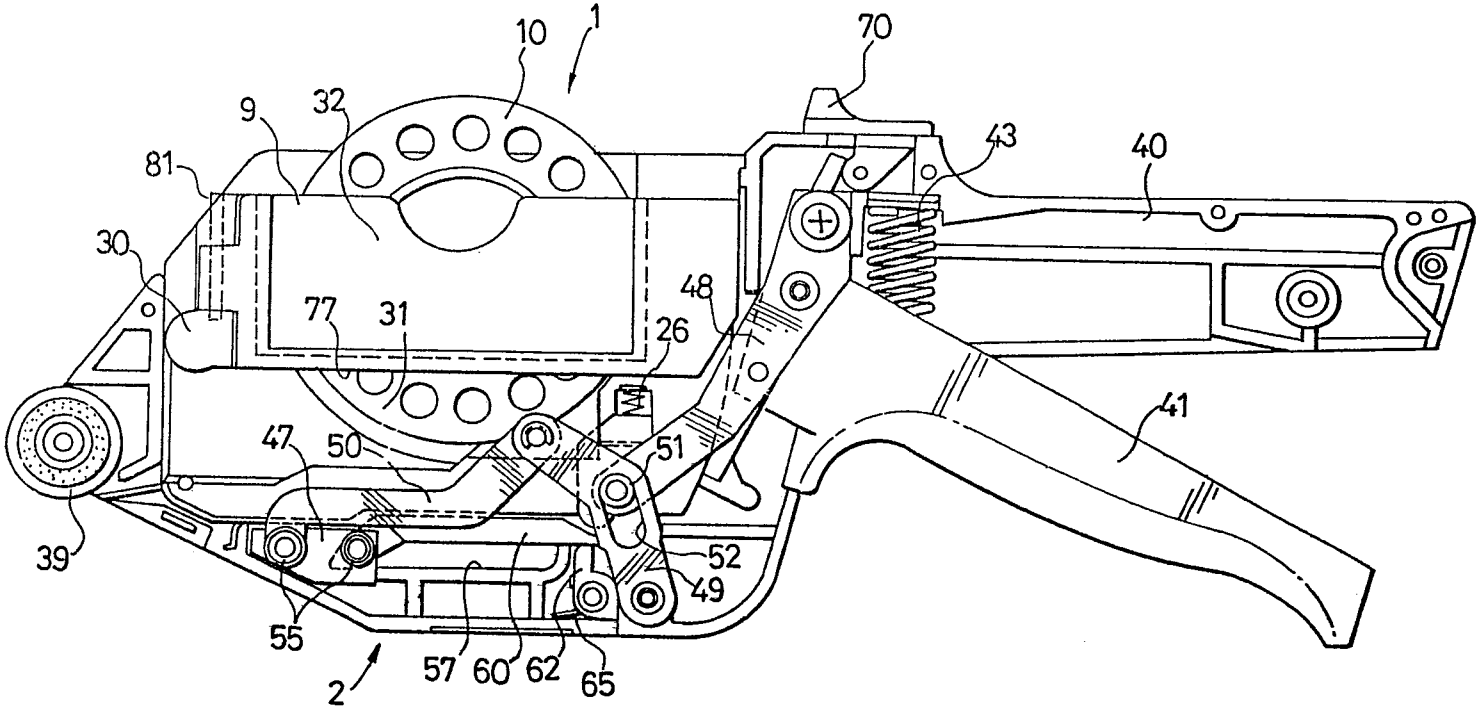

In the next step, the engaging projection 30 of the label cassette 1 is brought into engagement with the engaging recess 37 of the applying device 2 and the mounting portion 31 of the label cassette 1 is fitted into the receiving section 34 of the applying device 2. As a result, the raised portion 77 formed on both sides of the cassette 1 is held by the supporting section 35 of the applying device 2 and the label cassette 1 is automatically secured by the locking mechanism 67. At one side, the portion is the underside face of the closing plate 9. When the label cassette 1 is mounted, the engaging portion 73 moves downward upon turning the locking member 69 counterclockwise against the force of the spring 68. When the engaging portion 73 passes over the lower edge portion 71 of the locking member 69, the locking member 69 is returned to its original position, to lock by the engagement between the lower edge portion 71 and the engaging portion 73 (FIGS. 10A and 10B).

When the hand lever 41 is then squeezed, the supporting frame 47 is horizontally moved backward along the guide groove 57 by the linkage comprising the first, second and third links 48, 49 and 50 (FIG. 11A). The feeding pawls 45 of the pawl member 46 are in engagement with the feeding slits 78 (FIG. 8) which are formed at regular intervals in the backing paper 5, so that, in this operation, the backing paper 5 is also moved rearward. At the same time, the push-up plate 60 pushes up the engaging tongue piece 25 of the pressing member 20. As a result, the holding functions being performed by the pressing portion 22 of the pressing member 20 and the needle 23 are released. The backing paper 5 is thus smoothly shifted rearward and paid out from the machine body.

Figure 12:
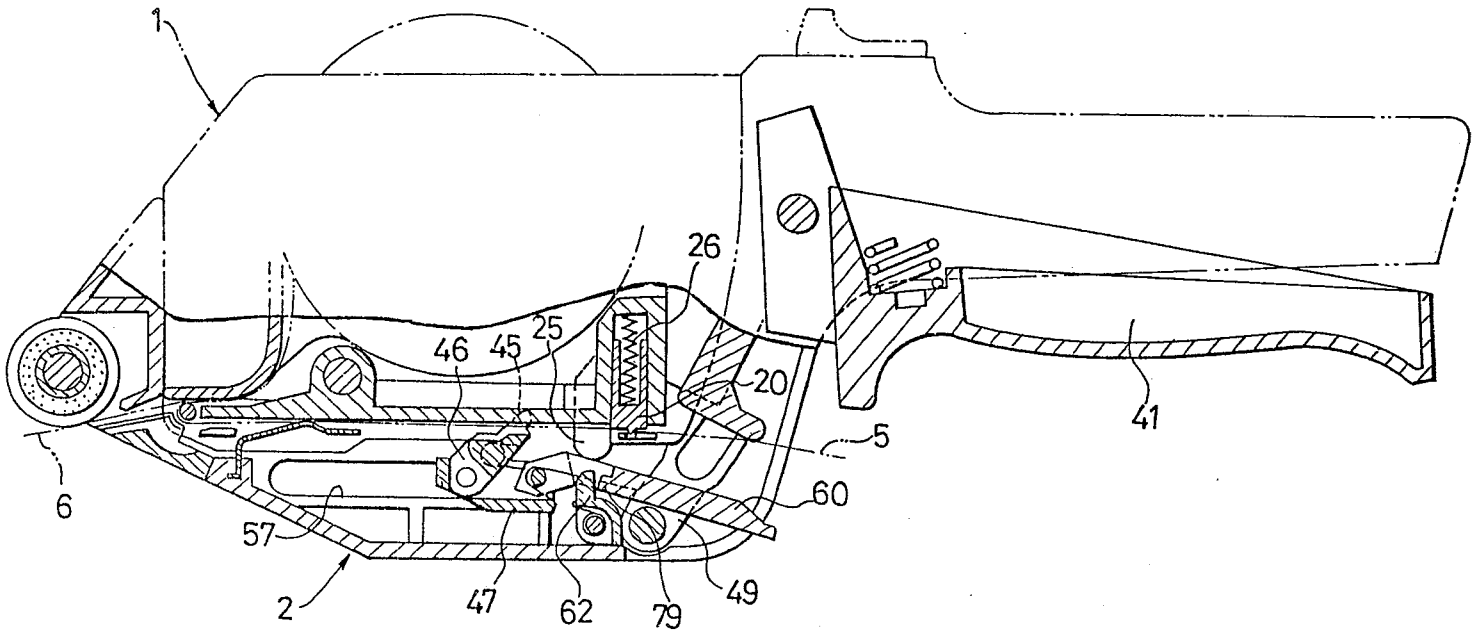
FIG. 12A is a vertical cross-sectional view of the main part of the portable label applying machine in which the hand lever is fully squeezed.
FIG. 12B is a side elevation of the portable label applying machine in which the machine frame on the near side is removed.
Figure 12:
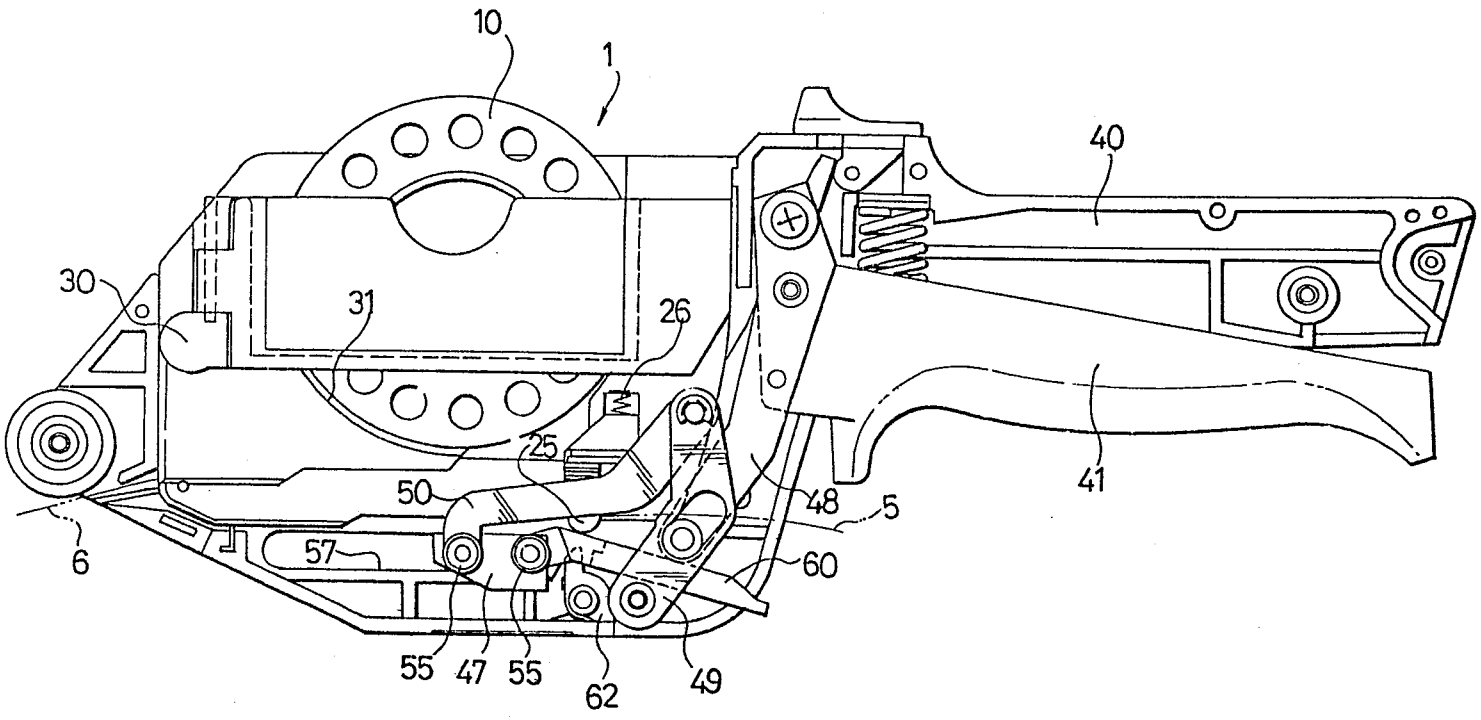

When the hand lever 41 is further squeezed as shown in FIGS. 12A and 12B, the push-up plate 60 is moved rearward and the engagement between the undersurface of the push-up plate 60 and the supporting member 62 is released. Therefore, the pressing member 20 is moved down to its original position by the force of the spring 26. This pushes down the push-up plate 60 clockwise and the backing paper 5 is again fixed by the pressing portion 22 and the needle 23.

In this shifting of the backing paper 5, only the backing paper 5 of the label strip 4 is bent backward at a sharp bend as the label strip 4 is horizontally depressed by the label pressing portion 13 at the turning pin 16 in the front portion of the machine body. In this bending of the backing paper 5, the label 6 is advanced and is peeled off the backing paper 5 to be delivered to the underside of the applying roller 39 through the label exit 38.

The manner of application of a label 6 to an article is the same as that in a conventional portable label printing and applying machine. That is, the adhesive carrying undersurface of the label 6 which is then held under the applying roller 39 is brought into contact with the surface of an article and the label is rubbed and applied by the applying roller 39.

When the hand lever 41 is released, it is returned to its original position by the force of the return spring 43. At the same time, the supporting frame 47 is moved forward to the position shown in FIGS. 10A and 10B, by the first to third links 48 to 50. In this forward movement of the supporting frame 47, as shown in FIG. 12A, the underside edge 79 of the push-up plate 60 comes into contact with the supporting member 62. However, the supporting member 62 is turned counterclockwise, because the force of the spring 26 exerted in pushing down the push-up plate 60 is greater than the resultant force of the springs 64 and 65. Accordingly, the push-up plate 60 is slid forward on the undersurface of the engaging tongue piece 25 without pushing up the tongue piece 25. The backing paper 5 is fixedly held by the pressing member 20 so that it is not returned forward by the pawl member 46. Thus, the feeding pawl 45 of the pawl member 46 comes out of the slit 78 of the backing paper 5 and, at the same time, it is turned clockwise against the force of the spring 59. The feeding pawl 45 slides forward under the backing paper 5 and it returns to the original position of FIG. 10A, wherein the feeding pawl 45 again comes into engagement with a feeding slit 78 in the backing paper 5.

Figure 13:
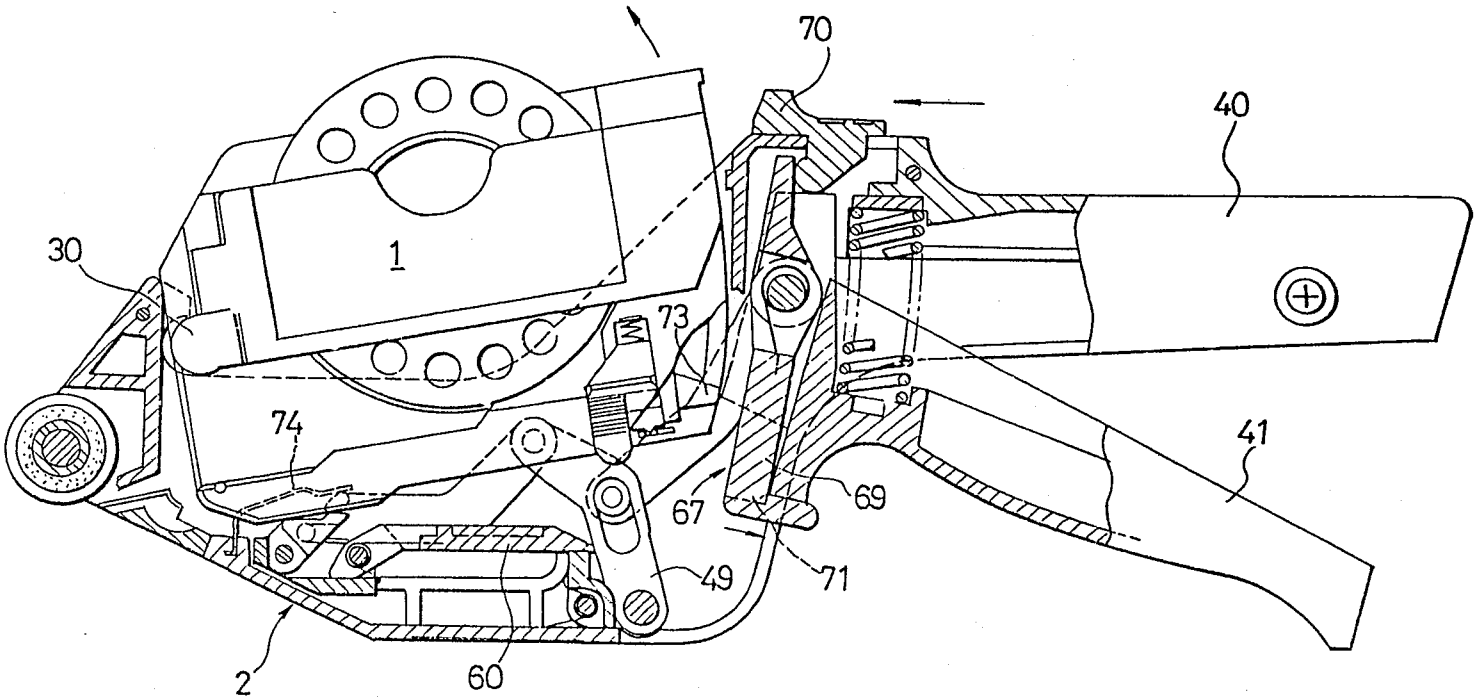
FIG. 13 is a side elevation partially in cross-section of the portable label applying machine in which the label cassette is being taken off.
Figure 14:
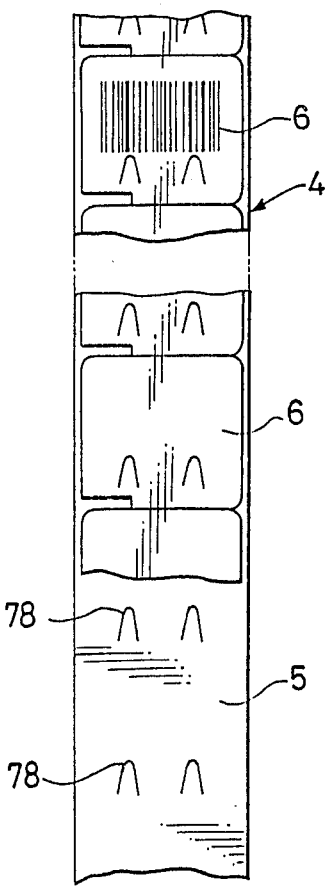
FIG. 14 is a plan view of a label strip on which bar codes are to be printed.

To remove the label cassette 1 from the applying device 2, the release button 70 is pushed forward as shown in FIG. 13. The locking member 69 is turned counterclockwise and the lower edge portion 71 thereof comes off the engaging portion 73 of the label cassette 1. At the same time, the rear side of the label cassette 1 is lifted up to some extent by the spring action of the backing paper pressing plate 74 which pushes up the undersurface of the backing paper 5 in the front portion of the backing paper guide groove 15. Therefore, the label cassette 1 can be detached without difficulty in a single operation.

The operation of the invention is now described. First, as shown in FIG. 9, the label cassette 1 is mounted on a printing device 85 to print bar codes or the like. The printing device 85 may comprise any well known type of printer including, but not limited to, a thermal printer. See, e.g. U.S. application Ser. No. 354,060, filed Mar. 2, 1982. The printing device 85 is connected to a power source and is also connected to a rotating shaft 75 which rotates in synchronism with the shifting of the printed label strip 4. A toothed wheel 76 on one side of the shaft 75 is engaged with a toothed wheel 11 of the label cassette 1.

Figure 15:
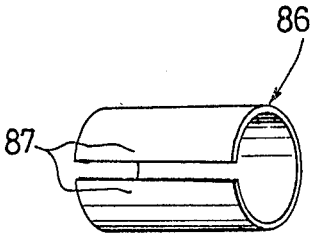
FIG. 15 is a perspective view of a securing member for retaining an end of the label strip of FIG. 14.

Further a winding member 86 having a C-shaped cross-section, as shown in FIG. 15 is fitted to the outside of the supporting cylinder 8 of the label cassette 1. This winding member 86 is made of an elastic material, such as metal or plastic, and the width of this member **86*b* is larger than that of the label strip 4. This may be an improved substitute for the slots 9*a* of FIG. 1**.

When printing is performed, the turning member 12 of the label cassette 1 is stood upright as shown in FIG. 9 and the free end of the label strip 4 is pulled out from the printing device 85. The free end of the label strip 4 is then inserted into the gap between an edge portion 87 of the winding member 86 and the outer surface of the supporting cylinder 8, thereby securing the label strip 4. After that, printing is started to print a predetermined number of labels 6. In this printing operation, the label strip 4 is wound up as the supporting cylinder 8 is rotated in synchronism with the shifting of the label strip 4 by the interlocking of the rotating shaft 75 and the toothed wheels 76 and 11. After the printing, the label strip 4 is cut off and the label cassette 1 is detached from the printing device 85.

In the next step, the backing paper 5 is bent rearwardly, as described above, and the label cassette 1 is attached to the label applying device 2 so as to perform the label applying operation.

In the practical use of the label applying machine according to the present invention, the rolled label strip 3 is attached to the label cassette 1 or a label strip 4 is wound as described above.

However, a plurality of label cassettes 1 having different kinds of rolled label strips 3, are prepared in advance and a suitable label cassette 1 is selected and it is attached to the applying device 2 in each use. In this way, since the label cassettes 1 can be interchanged by a single operation without difficulty, then only one applying device 2 is sufficient. This is quite economical.

The portable label applying machine of the present invention comprises a label cassette to carry a rolled label strip and an applying device which detachably holds the label cassette and peels the printed labels from the backing paper by a manually controlled operation and pays out the peeled labels in such manner that they may be readily applied to surfaces of articles.

When the label applying machine of the present invention having the above-described constitution is used, the following advantages are obtained:

(1) As the printing on labels is carried out by means of a separate printing device, the printed images are clear and accurate as compared with the ordinary label printing and applying machines and, when bar codes are used, check digits can be automatically calculated and printed by the printing device.

(2) Since the printing head is not necessary for the label applying machine,the machine can be made small in size and weight, which improves the work efficiency, accelerates label applying work and reduces the fatigue of operators.

(3) As compared with manual applying of labels, the applying speed can be increased without smudging, blurring or soiling the printed surfaces of labels.

(4) Since the replacement of the label cassette carrying a label strip can be performed by a single operation, changing of label strips can be done rapidly and easily.

(5) Only one applying machine is sufficient for various kinds of labels, thereby providing substantial economic advantage.

Although the present invention has been described in connection with a preferred embodiment thereof, many variations and modifications will now become apparent to those skilled in the art. It is not preferred, therefore, that the present invention be limited not by the specific disclosure herein, but only by the appended claims.

What is claimed is:

1. A portable label applying machine, comprising:

a printing device for printing a label strip in which the label strip comprises a plurality of labels removably positioned in series, one after the other, on a web of backing paper;

a separate applying device for applying labels which have been peeled from the web of backing paper to other objects, and including an applying section to apply peeled labels to other objects;

a separate cassette detachably mountable selectively on one of the printing device and the applying device; said cassette comprising a section for receiving and supporting thereon a printed label strip which is fed thereto from the printing device and also for feeding the label strip to a peeling section; a peeling section for bending only the backing paper web of the label strip in a direction and to an extent for peeling off the labels from the backing paper web; and a self-contained guide section for receiving and guiding the bent web of backing paper after the labels have been peeled off;

the applying device also including a manually operable feeding mechanism for engaging the backing paper web after the feeding section for moving the backing paper web through manual action, for effecting peeling of the labels from the backing paper web.

2. The portable label applying machine of claim 1, wherein the feeding mechanism of the label applying device comprises a feed pawl and manually graspable means supported to the applying device and movable for, in turn, moving the feed pawl to move the backing paper web after the backing paper web has passed the peeling section.

3. A portable label applying machine, comprising:

a cassette comprising: a support section for supporting thereon a label strip, wherein the label strip comprises a plurality of labels removably positioned in series, one after the other, on a web of backing paper; the cassette further comprising a peeling section, at which the label strip is fed forwardly, for bending only the backing paper web rearwardly of the cassette, and for causing the labels to peel from the backing paper web and move forwardly at the peeling section; a self-contained guide section in the cassette for receiving and guiding rearwardly the web of backing paper after the web of backing paper leaves the peeling section;

a backing paper pressing mechanism to press and secure the backing paper web at the cassette rearward of the peeling section;

a label applying device for detachably holding the cassette thereto; the applying device comprising a feeding mechanism for engaging the backing paper web after the peeling section and for feeding the backing paper web in the direction rearward of the cassette; means responsive to the operation of the feeding mechanism for releasing the backing paper pressing mechanism from pressing and securing the backing paper web, as the backing paper web is being fed by the feeding mechanism; an applying section for applying labels peeled from the backing paper web to other objects.

4. The portable label applying machine of claim 3, wherein the support section of the cassette comprises means for the label strip to be wound and supported in the wound condition on the cassette.

5. The portable label applying machine of claim 3, wherein the feeding mechanism of the label applying device comprises a feed pawl and manually graspable means supported to the applying device and movable for, in turn, moving the feed pawl to move the backing paper web in the direction rearward of the cassette after the backing paper web has passed the peeling section.

6. A cassette for having supported thereon a label strip and adapted for dispensing the labels of the label strip; wherein the label strip comprises a plurality of labels removably positioned in series, one after the other, on a web of backing paper;

the cassette including means for supporting the label strip thereon; a peeling section, at which the label strip is fed forwardly, for bending only the backing paper web in the direction rearward of the cassette and for causing the labels to peel from the backing paper web where the backing paper web is bent rearwardly; a self-contained guide section for receiving and guiding rearwardly the web of backing paper after the web of backing paper leaves the peeling section and for guiding and positioning the web of backing paper along the lower side of the cassette; the guide section being adapted to provide access to the backing paper web for an applying device to move the backing paper web in the direction rearward of the cassette and away from the peeling section.

7. The cassette of claim 6, wherein the support section of the cassette comprises means for the label strip to be wound and supported in the wound condition on the cassette.

8. The cassette of claim 6, wherein the guide section is adapted for supporting the backing paper from above to guide its movement along the lower side of the cassette and also for supporting the backing paper web from below, to hold the web in position for being engaged by the applying device, whereby the guide section defines the pathway for the backing paper web.

9. The cassette of claim 6, further comprising:

a backing paper pressing mechanism to press and secure the backing paper web at the cassette and rearward of the peeling section; the pressing mechanism being releasable to release the securement of the backing paper web and being closable for securing the backing paper web.

10. The cassette of claim 9, further comprising biasing means for normally biasing the pressing mechanism to the closed position thereof for securing the backing paper web.

11. The cassette of claim 6, further comprising a holding member on the cassette, the holding member being movable to an engaging position for engaging the label strip before the label strip is fed to the peeling section, and the holding member engaging the label strip for deflecting the label strip so that it bends more sharply at the peeling section; the holding member being movable away from the engaging position for enabling the label strip to be more easily passed to the peeling section before the holding member engages the label strip, and the holding member then being movable back to the engaging position for increasing the bending of the label strip.

12. The cassette of claim 11, wherein the holding member is pivotally mounted to the cassette for pivoting into the engaging position thereof and is pivotally mounted at a location upstream along the path of feeding of the label strip toward the peeling section.

13. The cassette of claim 12, wherein the support means of the cassette comprises means for the label strip to be wound and supported in the wound condition on the cassette; the holding member being pivotally mounted to the cassette at an axis and the label strip being wound on the cassette around the same axis.

14. A portable label applying machine, comprising:

a cassette comprising: a support section for supporting thereon a label strip, whrein the label strip comprises a plurality of labels removably positioned in series, one after the other, on a web of backing paper; the cassette further comprising a peeling section, at which the label strip is fed forwardly, for bending only the backing paper web rearwardly of the cassette, and for causing the labels to peel from the backing paper web and move forwardly at the peeling section; a guide section in the cassette for receiving and guiding rearwardly the web of backing paper after the web of backing paper leaves the peeling section;

the applying machine including a manually operable feeding mechanism for engaging the backing paper web which is still being guided along the cassette guide section, after the backing paper web has passed the peeling section; the feeding mechanism including a feeding pawl for engaging the backing paper web and including manually operable means for moving the feeding pawl to move the backing paper web.

15. The portable label applying machine of claim 14, wherein the feeding pawl is guided for movement along the path of the backing paper web.

16. The portable label applying machine of claim 15, wherein the support section of the cassette comprises means for the label strip to be wound and supported in the wound condition on the cassette.

17. The portable label applying machine of claim 15, wherein the manually operable means comprises a handle movable by a user for moving the feeding pawl.

18. The portable label applying machine of claim 17, wherein the handle is pivotally supported to the applying machine and is also connected with the pawl through a linkage which moves the pawl along the path of the backing paper web as the handle is pivoted.

19. The portable label applying machine of claim 15, wherein the feeding pawl is shaped for passing through an opening therefor defined in the backing paper web.

20. The portable label applying machine of claim 14, wherein the cassette further comprises a backing paper pressing mechanism to press and secure the backing paper web at the cassette rearward of the peeling section;

the applying device further comprising means responsive to the operation of the feeding mechanism for releasing the backing paper pressing mechanism from pressing and securing the backing paper web, as the backing paper web is being fed by the feeding mechanism; an applying section for applying labels peeled from the backing paper web to other objects.

21. The portable label applying machine of claim 20, wherein the feeding pawl is guided for movement along the path of the backing paper web;

the means responsive to operation of the feeding mechanism comprises means attached to the feeding pawl for movement therewith and that means also being shaped for acting upon the pressing mechanism for moving it to release the backing paper web.

22. The portable label applying machine of claim 21, further comprising biasing means for normally biasing the pressing mechanism to the closed position thereof for securing the backing paper web; the means responsive to operation of the feeding mechanism being adapted for moving the pressing mechanism in opposition to the bias of the biasing means.

* * * * *